US005334491A

United States Patent [19]

Foster et al.

[11] Patent Number: 5,334,491

[45] Date of Patent: Aug. 2, 1994

[54] PHOTOGRAPHIC BLEACH COMPOSITIONS AND METHODS OF PHOTOGRAPHIC PROCESSING

[75] Inventors: David G. Foster; Keith H. Stephen; Mary E. Craver, all of Rochester, N.Y.

[73] Assignee: Eastman Kodak Company, Rochester, N.Y.

[21] Appl. No.: 125,491

[22] Filed: Sep. 22, 1993

Related U.S. Application Data

[63] Continuation of Ser. No. 797,663, Nov. 25, 1991, abandoned.

[51] Int. Cl.[5] ..... G03C 7/42

[52] U.S. Cl. ..... 430/393; 430/430; 430/461

[58] Field of Search ..... 430/393, 430, 461

[56] References Cited

U.S. PATENT DOCUMENTS

| | | | |
|---|---|---|---|
| 4,242,442 | 12/1980 | Idota et al. | 430/393 |
| 4,268,618 | 5/1981 | Hashimura | 430/393 |
| 4,294,914 | 10/1981 | Fyson | 430/418 |
| 4,444,673 | 4/1984 | Ishikawa | 430/393 |
| 4,780,398 | 10/1988 | Kim | 430/461 |
| 4,822,725 | 4/1989 | Abe et al. | 430/393 |
| 5,061,608 | 10/1991 | Foster et al. | 430/461 |
| 5,070,004 | 12/1991 | Fujita et al. | 430/393 |
| 5,147,765 | 9/1992 | Goto et al. | 430/376 |

FOREIGN PATENT DOCUMENTS

| | | | |
|---|---|---|---|
| 272219 | 11/1987 | European Pat. Off. . | |
| 289007 | 4/1988 | European Pat. Off. . | |
| 412532 | 8/1990 | European Pat. Off. . | |
| 430000 | 11/1990 | European Pat. Off. . | |
| 3723307 | 1/1989 | Fed. Rep. of Germany | 430/430 |
| 80/00624 | 4/1980 | PCT Int'l Appl. . | |
| 91/11753 | 8/1991 | PCT Int'l Appl. . | |

*Primary Examiner*—Hoa Van Le

*Attorney, Agent, or Firm*—Sarah Meeks Roberts

[57] ABSTRACT

Bleach compositions and methods that are improvements over those provided by Fyson, U.S. Pat. No. 4,294,914, are disclosed. A highly preferred bleach composition of this invention (a) has the ferric complex of methyliminodiacetic acid as a bleaching agent, and additionally comprises (b) at least 0.9 mole of acetic acid per liter, (c) from about 15 to about 35 grams per liter of potassium bromide; and (d) has a pH of from about 2.5 to about 4.0.

This invention includes the discovery of a synergistic bleaching coaction of a bleach (i) comprising an alkyliminodiacetic acid such as methyliminodiacetic acid, and (ii) which has a pH of from about 3.5 to about 4.5, and (iii) in which the amount of ferric iron is from about 2 to about 16 grams per liter. This coaction between iron levels and pH was previously unknown and was unexpected.

Bleach formulations of this invention can be used in the processing of color photographic materials, such as film.

3 Claims, 1 Drawing Sheet

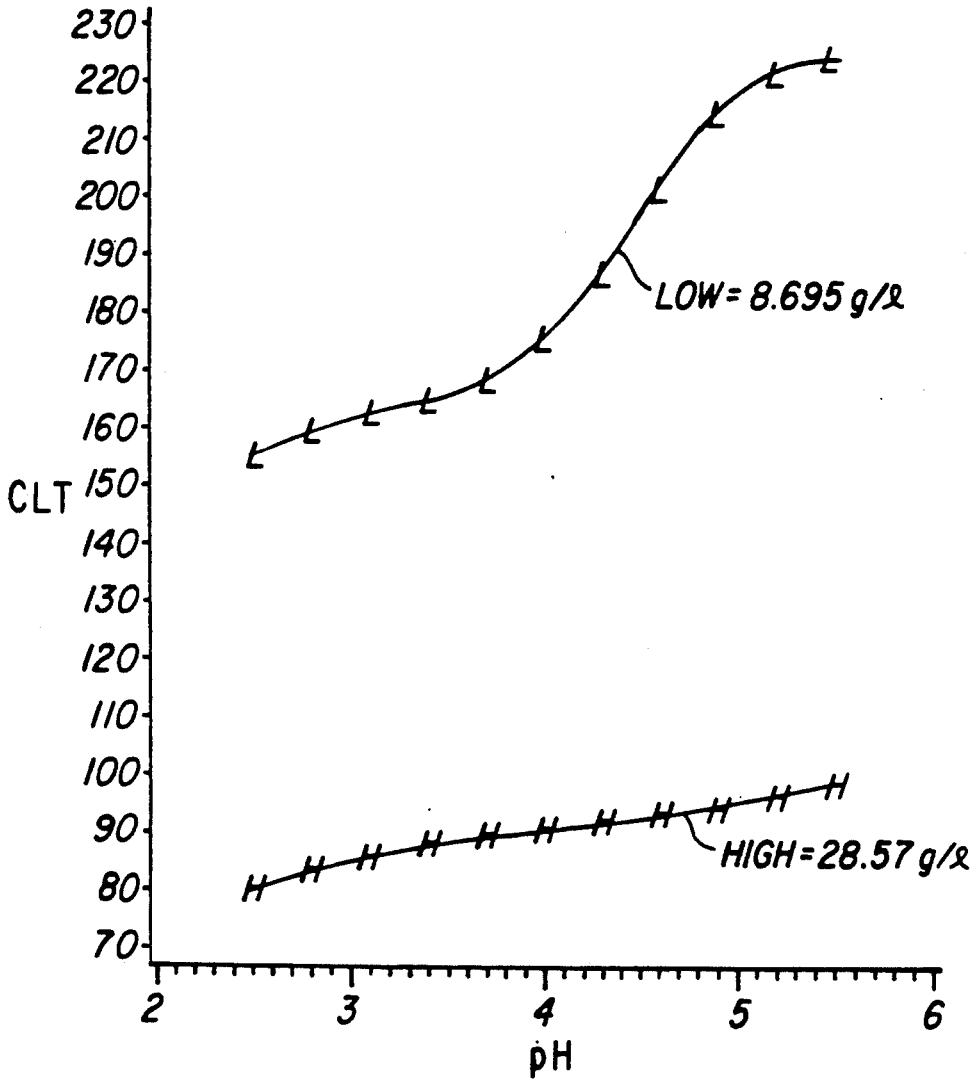
230
220
210
200
190
180
170
160
CLT 150
140
130
120
110
100
90
80
70
LOW = 8.695 g/ℓ
HIGH = 28.57 g/ℓ
2
3
4
5
6
pH

PHOTOGRAPHIC BLEACH COMPOSITIONS AND METHODS OF PHOTOGRAPHIC PROCESSING

This is a continuation of application Ser. No. 797,663, filed 25 November 1991 now abandoned.

FIELD OF THE INVENTION

This invention relates to photographic bleach compositions that contain the ferric complex of an alkyliminodiacetic acid, such as methyliminodiacetic acid, as a bleaching agent. This invention also pertains to photographic processing using such compositions.

BACKGROUND OF THE INVENTION

Fyson, U.S. Pat. No. 4,294,505, discloses bleach and bleach fix compositions and methods using a ferric complex of an alkyliminodiacetic acid. This invention comprises certain improvements over Fyson's compositions and methods. Thus, this invention comprises solutions and methods for bleaching metallic silver in photographic materials.

U.S. Pat. No. 5,061,608 discloses use of acetic, propionic, and succinic acid to inhibit bleach induced dye formation. In a preferred embodiment of this invention, bleach compositions of this invention are biodegradable, inasmuch as the alkyliminodiacetic acid portion of the compositions can be metabolized, at least to a significant extent, by microorganisms present in the environment. For biodegradability, methyliminodiacetic acid is a preferred ingredient of this invention.

This invention comprises in part use of pH levels not previously contemplated in the art, and it also provides the unexpected discovery of a synergistic bleaching interaction achieved at low iron and specified pH levels. Thus, the invention is considered to be a significant advance in the art. Moreover, bleaches provided by this invention achieve performance levels of current bleaches, using readily available materials that are well known. Consequently, this invention is readily adaptable by industry.

DESCRIPTION OF THE DRAWING

The Figure illustrates the synergism between iron and low pH which forms an important part of the discovery of this invention. This synergism is obtained when the iron content is from 2 to about 16, more preferably from about 2 to about 13 grams per liter.

In this Figure, CLT is the clear time of the bleach being used, Fe is the total iron level in the bleach formulation. The Figure illustrates that at high iron levels, CLT's are relatively independent of pH, but at low iron levels pH has a significant effect. The bleaching effects shown in the Figure were obtained using a color reversal film and a color reversal process. Similar results are obtained when color negative materials and processing are used.

SUMMARY OF THE INVENTION

In one aspect this invention provides a method of processing a photographic material, said method comprising bleaching said material with a bleach composition comprising an alkyliminodiacetic acid, and having a pH of from about 2.5 to about 4.0. In this method, it is preferred that the bleach composition additionally contains at least 0.35 mole, preferably at least 0.7 mole, and most preferably at least 0.9 moles per liter of acetic acid, propionic acid or succinic acid, which serves to reduce bleach induced dye stain. For this invention such acids are referred to as "stain reducing" acids. In this embodiment, it is also preferred that the bleach composition additionally contains from about 15 to about 35 grams per liter of potassium bromide.

In another aspect related to method, this invention provides a method of processing a photographic material, which comprises bleaching said material with a bleach composition comprising a ferric complex of an alkyliminodiacetic acid, (such as methyliminodiacetic acid), said composition containing from about 2 to about 16, more preferably 13 grams per liter of ferric iron, and having a pH of from about 3.5 to about 4.5. This composition, and the method described in the paragraph immediately above are inventive embodiments illustrated by the Figure.

In an aspect pertaining to composition of matter, this invention provides a photographic bleach composition comprising a ferric complex of an alkyliminodiacetic acid (such as methyliminodiacetic acid), said composition containing from about 2 to about 25 grams per liter of ferric iron, and having a pH of from about 3.5 to about 4.5.

This invention also provides an aqueous photographic bleach composition comprising the ferric complex of an iminodiacetic acid such as methyliminodicarboxylic acid, and having a pH of from about 2.5 to about 4.0.

Preferably, the compositions of this invention composition additionally contain at least 0.35, preferably at least 0.7, and most preferably at least 0.9 mole to about 0.9 moles per liter of acetic acid, propionic acid, succinic acid or mixture thereof acid, and from about 15 to about 35 grams per liter of potassium bromide.

DESCRIPTION OF PREFERRED EMBODIMENTS

As indicated above, an ingredient of this invention is an alkyliminodiacetic acid. Suitable acids of this type are described in the above-cited Fyson patent. Preferably, the acid is selected from methyliminodiacetic acid, and ethyliminodiacetic acid. The preferred acid is the methyl compound.

The alkyliminodiacetic acid is used as a ferric complex: more specifically, the acid is employed as a sodium, potassium or ammonium salt of the complex. It is not necessary that the iron and the iminodiacetic acid portions of the complex be present in the compositions in the stoichiometric proportion. It is preferred that the mole ratio of the acid to ferric iron be from about 1:1 to about 5:1. In a more preferred embodiment,the ratio is about 2 to about 3 moles of the diacetic acid per mole of ferric ion.

The potassium bromide can be employed in any effective amount, with useful amounts typically being at least 0.1 moles per liter, and preferably at least 0.25 moles per liter. The potassium halide converts silver ion to silver halide.

Water-soluble aliphatic carboxylic acids, useful in the bleaching solutions of this invention. One or more of these are used in sufficient amount to combat the undesirable increase in blue $D_{min}$ which results from bleach induced dye formation as set forth in U.S. Pat. No. 5,061,608 supra. As can be seen from the examples, the acids are devoid of the imino function.

The water-soluble aliphatic carboxylic acid serving as a stain reducing agent can be employed in any effective amount, with useful amounts typically being at least 0.35 moles per liter, and most preferably at least 0.9 moles per liter. Effective concentrations of acetic are exemplified in U.S. Pat. No. 5,061,608. Generally speaking, one uses an effective amount below the solubility limit of the acid.

The bleaching solutions of this invention are aqueous acidic solutions preferably having a pH in the range of from about 2.5 to about 4.0. In one embodiment, set forth above, the pH is from about 3.5 to about 4.5.

As indicated above, generally speaking the iron is present in from about 2 to about 25 grams per liter. Lower levels of about 2g/l are commonly used to bleach color paper. Levels of 10–25g/l are commonly used when rapid bleach action is desired. Levels of about 13g/l Fe are commonly employed to bleach color reversal materials.

tained by squaring the value for the square root of time, obtained by the least squares analysis.)

The blue Dmin value was determined for Ektar 125 film in accordance with the state of the art.

As is well known, indoaniline cyan dyes are fair oxidants with an inverse pH dependency. Thus, as the pH is lowered, the cross-oxidation with ferrous aminoacetic acid complex occurs with the consequent formation of leuco cyan dye, (or cyan leuco dye). This can be reversed by prolonged treatment with the bleach bath, as known in the art. A value in the Table of from −0.50 to −0.60 is deemed to be "in control" i.e. satisfactory.

Referring to the Table for purposes of illustration, the red record for Gold 400 film was not satisfactory after 60 or 90 seconds of treatment with Bleach 1. However, at 180 seconds, a satisfactory result was obtained.

TABLE

| Slot | | Fe | Br | pH | HOAc | Lig:Fe | Gold 400 Cleartime (seconds) | Ektar 125 BD min | LCD with Gold 400 | | | LCD with 5035 | | |
|---|---|---|---|---|---|---|---|---|---|---|---|---|---|---|
| | | | | | | | | | 60 sec | 90 sec | 180 sec | 60 sec | 90 sec | 180 sec |
| 1 | NH4+ | 15.1 | 150 | 6 | 13.9 | 1.1:1 | 110.25 | 0.910 | −0.94 | −0.83 | −0.53 | −1.26 | −1.02 | −0.49 |
| 2 | NH4+ | 15.1 | 150 | 6 | 13.9 | 5:1 | 68.1 | 1.134 | −0.63 | −0.52 | −0.53 | −0.52 | −0.49 | −0.47 |
| 3 | NH4+ | 15.1 | 150 | 4 | 10 | 5:1 | 65.6 | 0.85 | −0.95 | −0.75 | −0.64 | −1.04 | −0.74 | −0.65 |
| 4 | NH4+ | 15.1 | 25 | 4 | 10 | 2.63:1 | 65.6 | 0.958 | −0.57 | −0.52 | −0.51 | −0.52 | −0.48 | −0.50 |
| 5 | NH4+ | 6.7 | 25 | 4 | 1 | 5:1 | 112.36 | 0.897 | −0.88 | −0.81 | −0.55 | −1.02 | −0.72 | −0.53 |
| 6 | NH4+ | 6.7 | 25 | 4 | 10 | 2.63:1 | 118.8 | 0.903 | −0.75 | −0.64 | −0.54 | −0.76 | −0.57 | −0.51 |
| 7 | NH4+ | 6.7 | 25 | 4 | 50 | 2.63:1 | 112.0 | 0.862 | −0.89 | −0.77 | −0.51 | −0.90 | −0.64 | −0.52 |
| 8 | K+ | 6.7 | 25 | 4 | 50 | 2.63:1 | 114.0 | 0.849 | −0.86 | −0.79 | −0.55 | −0.96 | −0.66 | −0.52 |
| 9 | K+ | 6.7 | 41 | 4 | 50 | 2.63:1 | 112.4 | 0.852 | −0.92 | −0.79 | −0.53 | −0.94 | −0.65 | −0.51 |

To illustrate this invention, a series of bleaches containing methyliminodiacetic acid (MIDA) were prepared. The bleaches and their performances as compared, are set forth in the Table below. Referring to the Table, Bleaches 1 and 2 are bleaches illustrative of those provided by the above-cited Fyson patent, with acetic acid added. Those bleaches are not considered part of this invention.

All bleaches in the Table were prepared by the addition (to distilled water) of ferric nitrate, MIDA, and acetic acid in sufficient quantities to give the concentrations of those substances called for by the Table. The bromide ion was added to the formulation as potassium bromide, or ammonium bromide, depending on whether the bleach contained ammonium or potassium ion (see the second column of the Table). In order to give sufficient potassium or ammonium ion to form the potassium or ammonium salt of the ferric ion complex with MIDA, the required amount of ammonium hydroxide or potassium carbonate was added to the reaction mixture. Furthermore, the latter two substances were used when necessary to adjust the pH of the bleach solution to the value set forth in the Table. (In this regard, potassium bromide was used when the bleach contained potassium as set forth in the second colunmn of the Table, or ammonium bromide was used when an ammonium bleach was prepared.)

Test data was obtained using three color negative films manufactured by the Eastman Kodak Company, Rochester, N.Y., USA. The three films are Gold 400, Ektar 125, and Kodacolor II (referred to as "5035" in the Table.

A clearance time, measured with Gold 400 film, of less than 120 seconds was deemed satisfactory. Clearance times were obtained by a least squares analysis of the infrared Dmax step versus the square root of time. (For the table, the value in seconds reported was ob- Some comparisons are as follows: Bleach #1 compared to Bleach #2 shows the range of chelate to iron ratio described in the Fyson patent. Bleach #3 illustrates an advantage in faster bleaching with a pH of 4, which is clearly beyond Fyson. Bleach #4 shows that lowering the bromide and pH with a more optimized chelate to iron ratio is equal to higher bromide and chelate to iron ratios. This illustrates the optimization possible in our formulations. Bleach #5 is a lower iron and bromide version of Bleach #3, and Bleach #6 is a formulation better optimized for chelate to iron ratio. Bleach #7 is a higher acetic acid level formulation to reduce bleach induced dye formation using methods previously described by Foster and Stephen (U.S. application 469,102, supra). Bleach #8 is the potassium version of Bleach #7. Bleach #9 is a higher bromide version of Bleach #8, with the bromide levels in the range described by Fyson, illustrating no advantage.

The bleaching solutions of this invention can contain other addenda known in the art to be useful in bleaching compositions, such as sequestering agents, sulfites, and non-chelated salts of aminipolycarboxylic acids.

The compositions of this invention are bleaching solutions and not bleach-fixing solutions, and thus they are substantially free of fixing agents. The term "bleaching solution" as used herein is intended to exclude bleach-fixing solutions.

The bleaching solutions of this invention are especially useful in the color processing of photographic elements, including photographic films utilized in negative-positive processes or in color reversal processes. Useful processes include a three-step process—comprising the steps of color developing, bleaching and fixing—and a six-step process—in which the film is processed in a first developer, a reversal bath, a color developer, a conditioning bath, a bleach bath and a fixing bath. The processing is typically carried out using a color developing solution which contains a primary aromatic amino color developing agent. These color developing agents are well known and widely used in a variety of color photographic processes. They include aminopehenols and p-phenylenediamines.

Examples of aminophenol developing agents include o-aminophenol, p-amonophenol, 5-amino-2-hydroxytoluene, 2-amino-3-dydroxytoluene, 2-hydroxy-3-amino-1,4-dimetylbenzene, and the like.

Particularly useful primary aromatic amino color developing agents are the p-phenylenediamines and especially the N--dialkyl-p-phenylenediamines in which the alkyl groups or the aromatic nucleus can be substituted or unsubstituted. Examples of useful p-phenylenediamine color developing agents include:

N-N-diethyl-p-phenylenediaminemonohydrocholoride,

4-N,N-diethyl-2-methylphenylenediamine monohydrochloride, 4-(N-ethyl-N-2-methanesulfonylaminoethyl)-2-methylphenylenediamine sesquisulfate monohydrate, 4-N-ethyl-N-2hydroxethyl)-2-methylphenylenediamine sulfate, 4-N,N-diethyl-2,2'-methanesulfonylamino-ethylphenylenediamine hydrochloride, and the like.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent.

In both the negative-positive process and the color reversal process, the fixing bath converts all silver halide into soluble silver complexes which diffuse out of the emulsion layers. Fixing bath retained within the layers of the photographic element is removed in a subsequent water washing step. Thiosulfates, including ammonium thiosulfate and alkali metal thiosulfates such as sodium thiosulfate and potassium thiosulfate, are particularly useful as fixing agents. Other components of the fixing bath include preservatives and sequestering agents.

A commercially important process intended for use with color negative photographic elements which contain the couplers in the silver halide emulsion layers, or in layers contiguous thereto, utilizes, in order, the following processing baths: color developer, wash (optional), bleach, fix, wash and stabilizer. In accordance with this invention, such a process is carried out using the novel bleaching solution described hereinabove.

A commercially important process intended for use with color reversal photographic elements which contain the couplers in the silver halide emulsion layers, or in layers contiguous thereto, utilizes, in order, the following processing baths: first developer, wash, reversal bath, color developer, pre-bath (conditioner or prebleach), bleach, fix, wash and stabilizer. In this process, the first developer reduces the exposed silver halide to metallic silver; the reversal bath nucleates the silver halide that remains after first development, the color developer converts the nucleated silver halide to metallic silver and forms the dye images, the bleach converts all metallic silver to silver halide, the fix converts the silver halide into soluble silver complexes that are washed from the element, and the stabilizing bath improves image dye stability. The pre-bath mentioned above serves to enhance the effectiveness of the bleaching step and/or provide improved dye stability. In accordance with this invention, such a process is carried out using the novel bleaching solution described hereinabove.

The novel bleaching solutions of the present invention can be utilized with any of a wide variety of photographic elements. For a detailed description of useful photographic elements and methods for their manufacture, reference can be made to Research Disclosure, Item 17643, Vol. 176, December, 1978, published by Industrial Opportunities Ltd., Homewell, Havant Hampshire, P09 1EF, United Kingdom.

The photosensitive layers present in the photographic elements processed with the novel bleaching solutions of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, polymer-coated paper, and the like.

As indicated above, it is generally convenient for the ferric complex of the aminopolycarboxylic acid to be formed in situ in the bleaching solution by reaction of a ferric salt, such as ferric sulfate or ferric nitrate, with the iminodiacetic acid or mixture of such acids.

In a preferred embodiment, the bleaching solution of this invention is free, or at least substantially free of ammonium salts, as the presence of ammonium ions in a photographic bleaching solution is environmentally disadvantageous.

This invention has been described above with particular reference to preferred embodiments thereof. A skilled practitioner having the above detailed description can make many substitutions or alterations without departing from the scope or spirit of the appended claims.

We claim:

1. A method of processing an imagewise exposed and developed color silver halide photographic material containing an indoaniline cyan dye, said method comprising bleaching said material with a bleach composition having a pH of from about 2.5 to about 4.5; said bleach composition comprising a ferric methyliminodiacetic acid complex wherein the ratio of moles of methyliminodiacetic acid to moles of ferric iron is 2:1 to 3:1 and wherein the bleach composition contains from 2 to 25 grams per liter of ferric iron; and further comprising from 0.12 to 0.13 moles per liter of bromide ion.

2. The method of claim 1 wherein said bleach composition additionally contains at least 0.35 mole of stain reducing carboxylic acid per liter.

3. The method of claim 1 wherein the counter ion to the bromide ion is potassium.

* * * * *

IN THE UNITED STATES PATENT AND TRADEMARK OFFICE

CERTIFICATE OF CORRECTION

PATENT NO. : 5,334,491

DATED : August 2, 1994

INVENTOR(S) : David G. Foster, Keith H. Stephen, and Mary E. Craver

It is certified that an error appears in the above-identified patent and that said Letters Paten is hereby corrected as shown below:

Column 6, line 60, "0.13" should read --- 0.3 ---.

Signed and Sealed this

Eighth Day of November, 1994

*Attest:*

BRUCE LEHMAN

*Attesting Officer*

*Commissioner of Patents and Trademarks*